US008685503B2

(12) United States Patent
Zhou et al.

(10) Patent No.: US 8,685,503 B2
(45) Date of Patent: Apr. 1, 2014

(54) PAPER WITH SURFACE TREATMENT

(75) Inventors: Xiaoqi Zhou, San Diego, CA (US); Gracy Wingkono, San Diego, CA (US); Dave Edmondson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/387,483

(22) PCT Filed: Jan. 31, 2010

(86) PCT No.: PCT/US2010/022678

§ 371 (c)(1),
(2), (4) Date: Jan. 27, 2012

(87) PCT Pub. No.: WO2011/093896

PCT Pub. Date: Aug. 4, 2011

(65) Prior Publication Data

US 2012/0288645 A1 Nov. 15, 2012

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/52* (2013.01); *B41M 5/5218* (2013.01); *B41M 5/508* (2013.01); *B41M 5/5254* (2013.01)

USPC .... 428/32.2; 428/32.3; 428/32.34; 428/32.36

(58) Field of Classification Search

CPC ..... B41M 5/52; B41M 5/5218; B41M 5/508; B41M 5/5245

USPC ..... 428/32.2, 32.3, 32.34, 32.36

See application file for complete search history.

(56) References Cited

U.S. PATENT DOCUMENTS

| | | | | |
|---|---|---|---|---|
| 6,114,020 | A | 9/2000 | Misuda et al. | |
| 6,777,041 | B2 | 8/2004 | Yau et al. | |
| 7,152,973 | B2 | 12/2006 | Hann et al. | |
| 7,718,236 | B2 | 5/2010 | Yau et al. | |
| 2009/0066774 | A1 * | 3/2009 | Kubota et al. | 347/106 |

FOREIGN PATENT DOCUMENTS

JP 2006-334911 A * 12/2006 ..... B41M 5/00

OTHER PUBLICATIONS

International Search Report for PCT/US2010/022678 mailed Sep. 30, 2010.

Written Opinion for PCT/US2010/022678 mailed on Sep. 30, 2010.

Chinese Office Action for Chinese Application No. 201080034048.4 mailed on Aug. 1, 2013 corresponding to U.S. Appl. No. 13/387,483, filed Jan. 27, 2012.

Japanese Office Action for Japanese Application No. 2012-522820 mailed on Jul. 25, 2013 corresponding to U.S. Appl. No. 13/387,483, filed Jan. 27, 2012.

* cited by examiner

*Primary Examiner* — Betelhem Shewareged

(57) ABSTRACT

A surface-treated paper produced by applying a surface sizing composition to at least one surface of a base paper, wherein said surface sizing composition comprises a non-film-forming polymer latex and a metallic salt, said non-film-forming polymer latex has a minimum film-forming temperature (MFFT) of greater than 70° C., and said surface sizing composition does not form a continuous film on the treated surface.

15 Claims, No Drawings

PAPER WITH SURFACE TREATMENT

BACKGROUND

With rapid development of digital printing technology such as high-speed, inkjet web press printing, traditional printing papers face great challenges when used as the inkjet print media. In a typical inkjet printing system, ink droplets are ejected from a nozzle at high speed towards a print medium, e.g. paper, to produce an image on the medium. The inkjet ink usually contains a colorant, such as a dye or pigment, and a large amount of solvent. The solvent, or carrier liquid, typically is made up of water, or an organic solvent such as a monohydric alcohol, or mixtures thereof. In addition to good image quality and low cost, print media today are generally expected to be able to dry quickly and to avoid image feathering and image strike-through, especially when a sheet is printed on both sides.

The image quality which results from inkjet printing, including ink optical density (OD), color gamut, and the ink drying time, greatly depends on the interaction of the ink and the paper, and especially on the ink absorption capability of the paper. The ability of the paper to absorb the aqueous solvents in the ink and the speed at which it absorbs the solvents are major considerations in the manufacturing of media for receiving inkjet inks.

DETAILED DESCRIPTION

Printing papers made from cellulosic fibers are normally treated during the paper making processing by a process known as "sizing" using various sizing agents. Paper sizing includes internal sizing and surface sizing. Internal sizing involves adding sizing agents to the wet end of the papermaking process, i.e., to the pulp before sheet formation. Surface sizing is conventionally done by applying the sizing agents to the surface of the already formed paper sheet. The sizing chemicals are added for the purpose of improving bonding of the fibers and controlling the penetration of the liquid in the ink vehicle, typically water, into the final dried paper.

When such surface sizing agent is applied to the cellulosic paper, the sizing agent covers the cellulose fibers and forms a film thereon. Surface sizing improves the surface strength, printability and water resistance of the paper surface. When the paper is used for contact printing such as offset printing, the surface strength controlled by surface sizing is a critical attributor to printing quality. To make the paper surface strong enough to resist the external pulling force during contact printing, a strong fiber bonding via the adhesion effect of the film-forming surface sizing agent is highly desirable. For non-contact printing technologies such as inkjet printing, the paper's surface strength is not a dominating factor for controlling the printing quality as it does in contact printing. In fact, forming a polymeric, barrier layer film on the outermost surface of the paper inhibits rapid penetration of the inkjet ink's liquid carrier into the paper base, and hence, causes slow dry time and image defects such as mottling and coalescence. The term "mottling" refers to unevenness of the print optical density in a solid printed area. The term "coalescence" refers to the puddling of the ink in the solid filled areas.

Widely used surface sizing agents include virgin starch, converted or chemically-modified starches, hydrocolloid-like gelatin, water-soluble polymers such as polyvinyl alcohol, and synthetic polymeric dispersions such as latex. Most of conventional surface sizing agents currently being used are film-forming, naturally or synthetically made polymers. When conventional surface sizing formulations containing film-forming materials are applied to a paper web via a size press, the sizing formulations form a film on the surface of the paper web. This film seals the paper surface and renders the surface less porous. On the other hand, the film generally helps ink holdout on the paper surface to improve the saturation of the ink colorants. However, the drawback of film forming is, with greater ink holdout on the surface, slow ink drying time becomes an issue. Ink smear is also an issue with greater ink holdout. Secondly, when film-forming, surface sizing formulation penetrates into the bulk of the paper, it adversely impacts the opacity of the paper. In addition, such penetration adversely affects the fold and tear of the final paper. On the other hand, if inkjet printing is done on a paper with no surface sizing or very little surface sizing, the aqueous ink would penetrate deep into the thickness of the paper, resulting in reduced ink optical density, and furthermore, the ink would bleed along the fibers, causing feathering of the printed image. The challenge is to provide a surface sizing composition for inkjet media that could overcome the above issues.

The present disclosure provides an improved inkjet paper which is composed of a base paper having at least one surface thereof treated with a novel surface sizing composition containing at least one metallic salt and a non-film-forming polymer latex, as well as the method for making the same. It has been found that the surface sizing composition of the present disclosure improves the printing image quality by reducing feathering, ink bleeding and mottling without adversely affecting the ink dry time. The surface-treated (i.e., surface-sized) paper according to the present disclosure is suitable for various printing methods but it is particularly suitable for high-speed, inkjet web press printing, which requires fast ink dry time.

Conventional surface sizing treatment is typically film-forming surface sizing. The sizing agents can be either water soluble natural or synthetic polymers, or water-dispersible latex. The film formation of aqueous polymer latex is a physical transformation in which the latex particles aggregate as the liquid component of the latex emulsion evaporates, and subsequently, the latex particles deform and coalesce to form an integral film upon drying. The film formation of water-soluble polymeric substances such as starch and polyvinyl alcohol is slightly different from that of aqueous polymer latex in that, as the solvent evaporates, the macromolecules generate entanglement and form a continuous film. In both situations, the film formed has a continuous structure that is non-porous, which structure does not allow for fast penetration of liquids, e.g., the liquid carrier of the inkjet ink.

The novel surface sizing composition of the present disclosure does not contain any materials with amylum molecules such as starches found in potato, wheat, tapioca, rice, corn and sago. "Amylum molecule" refers to polysaccharide carbohydrate consisting of a large number of glucose units joined together by glycosidic bonds. The materials with amylum molecules, tend to form a film, which can adversely impact inkjet printing as discussed above. Cellulose reactive sizing agents such as alkyl ketene dimer (AKD) and alkenyl succinic anyhydride (ASA) are also omitted from the novel surface sizing composition because they are not compatible with the metallic salt in the composition.

The novel surface sizing composition of the present disclosure is based on a non-film forming sizing technology, wherein the sizing agents include non film-forming polymer latex which may be either syntactical or natural. The term "non-film-forming" refers to a polymer latex that is not capable of forming, by itself, an isolatable film at ambient temperature and temperatures exist in the intended use of the polymer latex. For non-film-forming latex, when the liquid carrier in the latex emulsion is dried up during dehydration, the polymer particles tend to aggregate together but the particles are relatively rigid and have the capability to resist deformation under capillary force, and consequently, no continuous film is generated. A critical property of the non-film-forming latex according to this disclosure is its minimum film-forming temperature (MFFT). The MFFT is defined as the minimum temperature at which the water-borne synthetic latex or emulsion will coalesce when laid on a substrate as a thin film, and is determined by the use of a MFFT Bar with the test condition described in ASTM D 2354. The preferred non-film forming polymer latex to be used in the novel surface sizing composition is a polymer latex with a minimum film-forming temperature (MFFT) that is greater than 70° C., more preferably, greater than 90° C. If MFFT is too low, film forming would occur. The function of the non-film-forming latex is not to form an over-coat film on top of the paper surface, which blocks the pores in the fiber structure and prevents the penetration of liquid, but to retain a liquid-permeable, porous surface for the paper being treated and simultaneously to alter the hydrophobicity of the paper (i.e., making it more hydrophobic). The surface sizing composition to be applied to the base paper is a stable dispersion of generally spherical or spherical-like particles made of non-film-forming polymer. Alternatively, the particles of the non-film-forming polymer latex may have a non-spherical shape such as an ellipsoid or a rod-like shape, but preferably, the polymer particle is spherical. The dispersion may be provided in the form of a stable dispersion of polymer nanoparticles (i.e., particles of nanometer sizes). The nanoparticles are sized between 1 nm to 500 nm, preferably from 10 nm to 300 nm, more preferably from 20 nm to 200 nm. Dispersion containing particles with sizes above about 1000 nm becomes much less stable and less effective in its sizing effect. Exemplary non-film-forming latexes that are commercially available include Basoplast 265D from BSAF, NeoCryl XF-25 from Avercia, Joncryl 62, Joncryl 87, Joncryl 89, Joncryl 90, Joncryl 134, Joncryl 530, and Joncryl 618, Joncryl SCX 8082, supplied by BASF, "Neocryl® XK 52" supplied by Avecia Resins, Rhodopas® 5051" supplied by Rhodia Chimie.

After surface sizing, the non-film-forming latex is present in the form of small particles, which are embedded in the porous channels formed in the fibrous structure of the paper. The amount of the non-film-forming latex applied to the base paper, as measured in dry weight, may range from 0.5% to 1% based on dry fiber mass. This amount is significantly higher than the amount of synthetic film-forming sizing agents, e.g. as styrene maleic anhydride copolymer (SMA), styrene acrylate emulsions (SAE), polyurethane dispersions (PUD) and ethylene acrylic acid copolymers (EAA), normally used in conventional surface sizing methods (usually in the range of 0.05% to 0.15% based on dry fiber mass). The synthetic film-forming agents used in conventional surface sizing methods are usually applied together with starch, whereby the synthetic film-forming agent barely penetrates into the bulk of the paper web, and instead, deposits on the paper surface together with starch.

The non-film-forming polymers for use in the novel surface sizing composition may include, as examples, a free-radical polymer, a polycondensate, a polymer of natural origin, a copolymer with different chain units, or mixtures thereof. The glass transition temperature ($T_g$) of these homopolymers and/or copolymers may vary, as long as the minimum film-forming temperature (MFFT) is greater than 70° C. as discussed earlier. MFFT is a physical property determined not only by the molecule structure and molecular weight of the polymer, as reflected in glass transition temperature of the polymers, but also the morphology of the polymers and the processing conditions used during polymerization, e.g. the concentration of the emulsifiers used in polymerization.

In an embodiment, the non-film forming polymer latex include materials made from free radical polymerization and condensation polymerization such as homopolymers or copolymers of ethylene, cycloethylene and naphthylethylene, homopolymers or copolymers of propylene, substituted propylene like hexafluoropropylene, polycarbonates, polyurethanes, polyesters, polyamides, and mixtures thereof. In a preferred embodiment, the non-film-forming latex is made from free radical emulsion polymerization. Examples include the latex made from acrylic ester monomers including methyl acrylate, ethyl acrylate, butyl acrylate, 2-ethylhexyl acrylate, decyl acrylate, methyl methacrylate, butyl methacrylate, lauryl (meth)acrylate, isobornyl (meth)acrylate, isodecyl (meth) acrylate, oleyl (meth)acrylate, palmityl (meth)acrylate, stearyl (meth)acrylate, hydroxyethyl (meth)acrylate, and hydroxypropyl (meth)acrylate; acrylamide or substituted acryl amides; styrene or substituted styrenes; butadiene; ethylene; vinyl acetate or other vinyl esters; vinyl monomers, such as vinyl chloride, vinylidene chloride, N-vinyl pyrrolidone; amino monomers, such as N,N'-dimethylamino (meth) acrylate; acrylonitrile or methacrylonitrile. These monomers can be polymerized into polymer latex particles with a single-phase morphology. Alternatively, the non film-forming latex may have the morphology of multiple phases, such as core/lobe particles, core/shell particles, core/sheath particles, core/shell particles with shell phases incompletely encapsulating the core, core/shell particles with a multiplicity of cores, interpenetrating network of particles, particles having a dipole morphology, in which each phase forms separate but connected lobes, and particles having multiple phases on the surface of another polymer phase.

In one embodiment, a non-film-forming, multiple-phase latex with a core/shell structure is used. The core structure of the latex particle is made of a non-film-forming polymer, which has MFFT, when homo-polymerized alone, of greater than 90° C., and the shell in the outer portion is made of a film-forming polymer, which has MFFT, when homo-polymerized alone, of lower than 40° C. However, the total content of film-forming polymer in the particle is about 5% by volume or less. This type of particle structure is particularly useful because the rigid, non-film-forming core will resist particle deformation and coalescing under capillary force upon the dehydration of the polymer latex emulsion and will maintain the non-film-forming status, whereas the softer, outer shell with low MFFT will provide the adhesion force to the particles so as to avoid any dusting issue during printing. The non-film forming polymer may also take the form hollow polymer particles or polymer encapsulated particles There is no particular limitation on the surface charge of the particles of the non-film-forming polymer latex. It can be cationic, anionic, or electrically neutral. In an embodiment, the non-film forming latexes with cationic charged particles is preferable since both the cellulose fibers and pigmented ink colorant are normally anionic charged species, a cationic charged particle can help to improve bonding to both fibers and colorants, and cationic charged particles are also more compatible with metallic salt. In an embodiment, the zeta potential of such cationic charged, non-film-forming latex is ranging from 10 to 100 mV, as measured by a Malvern Zetamaster, more preferably, from 20 to 60 mV in the pH range of 3 to 6.

The polymeric particles of the non-film-forming latex modify the paper surface by changing the degree of hydrophilicity of the fibers, while leaving some fiber surface available through the non-film forming porous structure to soak up the large amount of water that is introduced with the aqueous inkjet inks during printing, thereby maximizing the ink dry time. However, the non-film-forming polymer latex could not provide the liquid barrier effect provided by the film-forming latexes used in conventional surface sizing. Without a liquid barrier, ink penetration would occur and less ink would remain on the paper surface during printing, resulting in lower ink optical density, and consequently, a "fading" image. The presence of metallic salt in the novel surface sizing composition of the present disclosure prevents the negative effect of such ink penetration. When pigmented inks are used for inkjet printing, the cationic metal ions of the salt can crash out the ink suspension and electrically bond the anionic charged pigment particles on the outermost layer of the paper being printed.

The metallic salts used in the surface sizing composition may include water-soluble, mono-valent or multivalent metallic salts. The metallic salts may include cations of mono-valent metal ions, multivalent metal ions, combinations and derivatives thereof. Examples include Group I metals, Group II metals, and Group III metals. Non-limiting examples include metal cations such as potassium, sodium, calcium, magnesium, barium, strontium, and aluminum ions. The metallic salt may further include anions such as fluoride, chloride, iodide, bromide, nitrate, chlorate, and acetate ions, various combinations and derivatives thereof. Anions which are known to readily interact with and bind with the paper pulp are excluded from use with the metallic salt, e.g., anions based on sulfur and phosphorous. The amount of metallic salt used in surface sizing composition varies according to the degree of internal sizing. In general, a base paper with a higher degree of internal sizing requires less amount of metallic salt. In an embodiment, the load amount of the salt applied, in terms of dry weight, may range from 3.0 kg/Ton to 10.0 kg/Ton of base paper.

To further enhance the adhesion of the non film-forming particles with the cellulosic fibers, a binder may optionally be added to the surface sizing composition, but it is not necessary. If added, the binder is used very sparingly to avoid film-forming. Binders such as low molecular weight polyvinyl alcohol (PVA) are preferred because they have a weak film forming behavior. It has been found that as long as the amount of binder is not over 30% by weight of the non-film-forming latex, the sizing composition will maintain a good non-film-forming behavior.

With regard to the base paper, it may be a raw paper stock made from cellulosic fibers, but is not limited thereto. The type of fibers is not specifically limited, and any fibers known for paper making may be used. For example, the base paper may be made from pulp fibers derived from hardwood trees, softwood trees, or a combination of hardwood and softwood trees prepared for use in papermaking fiber furnish by any known suitable digestion, refining, and bleaching operations as are, for example, known in mechanical, thermo-mechanical, chemical and semi-chemical pulping, and other well-known pulping processes. The term "hardwood pulps" refers to fibrous pulp derived from the woody substance of deciduous trees (angiosperms) such as birch, oak, beech, maple, and eucalyptus. The term "softwood pulps" refers to fibrous pulps derived from the woody substance of coniferous trees (gymnosperms) such as varieties of fir, spruce, and pine, for example, loblolly pine, slash pine, Colorado spruce, balsam fir and Douglas fir. In certain embodiments, at least a portion of the pulp fibers may be provided from non-woody herbaceous plants including, but not limited to, kenaf, hemp, jute, flax, sisal, or abaca. Either bleached or unbleached pulp fibers may be utilized for making the base paper. In addition, recycled pulp fibers are also suitable. As an example, the cellulosic fibers in the base paper may include from about 30% to about 100% by weight of hardwood fibers and from about 0% to about 70% by weight softwood fibers.

Additionally, a number of fillers may be included in the above mentioned pulps during the formation of the base paper. According to one exemplary embodiment, the fillers that may be incorporated into the pulp to control physical properties of the final paper include, but are in no way limited to, ground calcium carbonate, precipitated calcium carbonate, titanium dioxide, kaolin clay, and silicates. The amount of fillers may vary widely. According to one embodiment, the filler is present in an amount ranging from 0% to approximately 40% by weight of the dry fibers, and according to another embodiment, the filler is present in an amount ranging from approximately 10% to approximately 20% by weight of the dry fibers.

In a preferred embodiment, the improved inkjet paper of the present disclosure is subjected to both internal sizing and surface sizing. Internal sizing is accomplished by adding chemical sizing agents at the wet end of the paper making process. The internal sizing agent may be selected from conventional internal sizing agents. Rosin, alkyl ketene dimer (AKD), and alkenylsuccinic anhydride (ASA) are examples of suitable internal sizing agents. Alkenyl ketene dimers and ketene multimers may also be used for internal sizing as disclosed in U.S. Pat. No. 5,846,663.

The degree of internal sizing in the base paper is critical to achieve an optimum printing quality and improved paper physical property. Without forming a continuous, sealing film on the paper web surface, the effect of internal sizing will interact with the non-film-forming polymer and metallic salt in the surface sizing composition to control the penetration of aqueous ink. In an embodiment, the Hercules Sizing Test (HST) value of the base paper (before surface sizing) is in the range of 10-1000 seconds, preferably, in the range of 50-800 seconds, and more preferably, in the range of 100-300 seconds. A higher HST number represents higher degree of internal sizing (hard sizing) and better ability to resist wetting.

The Hercules Sizing Test (HST) is conventionally used to characterize the degree of internal sizing. The Hercules Size Test determines the degree of water sizing obtained in paper by measuring the change in reflectance of the paper's surface as an aqueous solution of dye penetrates from the opposite surface side. Test duration is limited by choosing a convenient end point, e.g., a reduction in reflected light of 20%, corresponding to 80% reflectance. A timer measures the time (in seconds) for the end point of the test to be reached. Longer times correlate with increased sizing performance, i.e., resistance to water penetration increases. Un-sized paper will typically less than 5 second, lightly sized paper will register times less than 15 seconds, moderately sized paper from about 20 to about 150 seconds, and hard sized paper is above 150 to about 2000 seconds or more.

The novel surface sizing composition of the present disclosure is an aqueous dispersion prepared by mixing non-film-forming latex emulsion and metallic salt together. Water, color dye and other processing aids such as pH controlling agent, defoamer, and lubricators may be added as needed. In the conventional surface sizing compositions containing film-forming agents such starch, at least one optical brightening agent (OBA) is often included to optically compensate for the yellowing of paper over time. Paper OBA's are usually stilbene-based, and the most frequently used are derivatives of 4,4'-diaminostilbene-2,2'disulphonic acid and in particular the bistriazinyl derivatives (4,4'Bis(triazine-2-ylamino)stilbene-2,2'disulphonic acid). When used in paper, the OBA is typically in an anionic form or, at least, partially anionic. If such OBA is used in the non-film-forming sizing composition which comprises metallic salt, it can be electrostatically attracted to the cationic ions of the metallic salt. This interaction interferes with the fluorescence of the OBA, often in such a way that the fluorescence is quenched and the OBA loses its effect. For this reason, it is not desirable to directly add anonically charged OBA into the surface sizing formulation but add the OBA at the wet end of the papermaking process, or use encapsulated OBA particles as described earlier.

The aqueous surface sizing dispersion can be applied onto the base paper using any surface sizing techniques known in the art. As non-limiting examples, surface sizing may be accomplished via a size press, a slot die, a blade coater, or a Meyer rod. The size press may include puddle size press, film size press and the like. The puddle size press may be configured to have horizontal, vertical, or inclined rollers. The film size press may include a metering system, such as gate-roll metering, blade metering, Meyer rod metering, or slot metering. As an example, a film size press with short-dwell blade metering may be used as an application head for applying the surface sizing composition. Moreover, the surface sizing composition may be applied to the base paper off-line or in-line of a paper-making machine. After surface sizing, the sized paper is subsequently dried, e.g., using infrared heating or heated air or a combination thereof. Other conventional drying methods and equipments may also be used as is known in the art.

The base paper may take the form of a sheet or web having a basis weight in the range of 30 to 350 gsm. The amount of sizing composition applied to the base paper, as measured in dry weight of solid content, is 6-20 kg/Ton of base paper, wherein 40%-60% by weight is metallic salt. The surface-treated paper is ready for inkjet printing and does not require prior art coatings, such as ink-receptive coatings that include inorganic pigments. In fact, the sizing composition of the present disclosure is void of inorganic pigments typically used in ink-receptive coatings (e.g. clays, talc, calcium carbonate, kaolin, silica etc.).

EXAMPLES

The following Examples will serve to illustrate representative embodiments and should not be construed as limiting of the disclosure in any way. All parts referred to herein are by weight unless otherwise indicated.

Example 1

A surface sizing composition was prepared according to the formulation shown in Table 1.

TABLE 1

| Surface sizing formulation 1 | |
|---|---|
| | Parts |
| Cationic acrylic polymer dispersion | 81 |
| Calcium Chloride | 100 |
| Water | 328 |

The formulation was prepared in the laboratory with batch size 1000 g of sizing formulation. $CaCl_2$ was pre-dissolved in a separate container to form a salt solution with a concentration of 32%, and then mixed with the non-film-forming latex (cationic acrylic polymer dispersion). Surface sizing was completed in a lab surface sizing machine on both sides of the uncoated base paper with HST value of 300 seconds. The surface-sized paper was then dried by a hot air dryer at the temperature around 90° C.

Example 2

A surface sizing composition was prepared according to the formulation shown in Table 2.

TABLE 2

| Surface sizing formulation 2 | |
|---|---|
| | Parts |
| Core-shell copolymer latex[1] | 87 |
| Calcium Chloride | 100 |
| Water | 360 |

[1]latex was prepared with methacrylate as the monomer of the core, and maleic acid/vinyl, acetate/butyl acrylate as the monomers for the shell.

An uncoated base paper with HST value of 300 seconds was treated with the surface sizing formulation 2 using the same surface sizing method described in Example 1.

Example 3

A surface sizing composition was prepared according to the formulation shown in Table 3. The sizing agent comprises a non-film-forming latex same as in Example 1 and a film-forming binder, polyvinyl alcohol (PVA).

TABLE 3

| Surface sizing formulation 3 | |
|---|---|
| | Parts |
| Cationic acrylic polymer dispersion | 76 |
| Calcium Chloride | 100 |
| PVA | 5 |
| Water | 395 |

An uncoated base paper with HST value of 300 seconds was treated with the surface sizing formulation 3 using the same surface sizing method described in Example 1.

Example 4 (Comparative)

For comparison, a surface sizing composition was prepared according to the formulation shown in Table 4. The sizing agent comprises a film-forming starch and synthetic polymer latex.

TABLE 4

| Surface sizing formulation 4 | |
|---|---|
| | Parts |
| Panford gum 280 (starch) | 100 |
| Calcium Chloride | 10 |
| Stryrene acrylate emulsion | 0.3 |
| Water | 350 |

An uncoated base paper with HST value of 20 seconds (a weak internally sized paper) was treated with the surface sizing formulation 4 using the same surface sizing method described in Example 1.

Example 5 (Comparative)

A surface sized paper was prepared using a surface sizing formulation comprising a film-forming starch and synthetic polymer latex, same as in Example 4. The base paper used in this example was a "hard" internally sized paper with a HST value of 300 seconds.

Example 6 (Comparative)

A surface sized paper was prepared using a surface sizing formulation comprising a film-forming starch and synthetic polymer latex, same as in the Example 4 but without $CaCl_2$ salt. The base paper used in this example was a "hard" internally sized uncoated paper with a HST value of 300 seconds.

All of the surface-sized papers prepared in Examples 1-6 were printed and evaluated for print quality. The results are summarized in Table 5. The surface-sized papers were printed using HP CM8060 Color MFP with Edgeline Technology manufactured by Hewlett-Packard Co. The black optical density (KOD) measurements were carried out on the same surface-sized papers using an X-Rite densitometer to measure the blackness of the area filled. The higher value indicates a darker printing effect. The color gamut of each printed image was recorded. The color gamut measurements were carried out on squares of primary color (cyan, magenta, and yellow) and secondary colors (red, green, and blue) plus white (unimaged sheets) and black colors. L*a*b* values were obtained from the measurement and thereafter were used to calculate the 8-point color gamut, where the higher value of color gamut indicates that the prints show richer or more saturated colors. Strikethrough was measured with the same test method and tool used for the KOD measurement as described previously, however, the measurement for strikethrough was conducted on the back-side of the printed area. The OD reading for strikethrough was corrected with the paper's baseline OD (paper's OD when measured at an unprinted area). The lower the OD reading on the unprinted side, the better the strikethrough performance. The edge acuity of the black-to-yellow bleed was measured with a QEA Personal Image Analysis System (Quality Engineering Associates, Burlington, Mass.). Smaller values are indicative of better edge quality of the printed image.

TABLE 5

| | KOD | Color Gamut | Strike-through OD | Black-to-Yellow color bleed (u) |
|---|---|---|---|---|
| Ex. 1 | 1.46 | 186k | 0.04 | 15.4 |
| Ex. 2 | 1.41 | 175K | 0.03 | 13.8 |
| Ex. 3 | 1.45 | 191K | 0.03 | 18.2 |
| Ex. 4 | 1.34 | 168K | 0.04 | 14.4 |
| Ex. 5 | 1.51 | 193k | 0.02 | 26.5 |
| Ex. 6 | 0.88 | 169k | 0.07 | 30.0 |

The data in Table 5 shows that surface-sized papers prepared in Examples 1, 2, 3 (papers treated with non-film-forming sizing compositions) delivered the best print quality—highest black OD, highest color gamut, and the lowest strike-through OD and ink bleed on the unprinted side, as compared to the surface-sized paper prepared in Example 5 (paper treated with film-forming sizing composition) and the paper prepared in Example 6 (paper without salt). For film-forming sizing formulations, bleeding is not an issue (Example 4) but the bleeding problem was observed with the same sizing agents on high HST base paper (Example 5).

While several embodiments have been described in detail, it will be apparent to those skilled in the art that the disclosed embodiments may be modified. Therefore, the foregoing description is to be considered exemplary rather than limiting.

What is claimed is:

1. A paper for inkjet printing, comprising:

a base paper which has been treated on at least one surface with a surface sizing composition comprising a non-film-forming polymer latex and a metallic salt such that the surface treated retains its porosity, wherein said non-film-forming polymer latex has a minimum film-forming temperature (MFFT) of greater than 70° C. and wherein said surface sizing composition does not form a continuous film on the treated surface.

2. A surface-treated paper produced by applying a surface sizing composition to at least one surface of a base paper, wherein said surface sizing composition comprises a non-film-forming polymer latex and a metallic salt, said non-film-forming polymer latex has a minimum film-forming temperature (MFFT) of greater than 70° C., and said surface sizing composition does not form a continuous film on the treated surface.

3. The paper of claim 1, wherein the amount of said surface sizing composition applied to the base paper, as measured in dry weight of solid content, is 6-20 kg/Ton of base paper, wherein 40%-60% by weight is metallic salt.

4. The paper of claim 1, wherein said base paper comprises a fibrous structure with porous channels formed therein, and wherein the polymer particles of the non-film-forming polymer latex are embedded in at least some of the porous channels.

5. The paper of claim 1, wherein said base paper is made from cellulosic fibers and the amount of the non-film- forming polymer latex applied to the base paper, as measured in dry weight, is ranging from 3% to 15% based on dry fiber mass.

6. The paper of claim 1, wherein said non-film-forming polymer latex comprises nano-particles having particle sizes in the range of 1 nm to 500 nm.

7. The paper of claim 1, wherein said base paper is internally sized to have Hercules Sizing Test (HST) value in the range of 10-1000 seconds prior to surface sizing.

8. The paper of claim 1, wherein the non-film-forming polymer latex comprises polymer particles having a core/shell structure, wherein said core/shell structure has a core made of non-film-forming polymer with MFFT of greater than 90° C., and an outer shell made of a film-forming polymer with MFFT of lower than 40° C., and the total content of film-forming polymer in each particle is about 5% by volume or less.

9. The paper of claim 1, wherein said metallic salt is a water-soluble, mono-valent or multivalent metallic salt.

10. The paper of claim 9, wherein said metallic salt is calcium chloride.

11. The paper of claim 1, wherein said surface sizing composition is void of any material with amylum molecules or starch.

12. The paper of claim 1, wherein the non-film-forming polymer latex includes materials made from free radical polymerization and condensation polymerization such as homopolymers or copolymers of ethylene, cycloethylene and naphthylethylene, homopolymers or copolymers of propylene, substituted propylene like hexafluoropropylene, polycarbonates, polyurethanes, polyesters, polyamides, and mixtures thereof.

13. A method for surface sizing paper comprising:

applying a surface sizing composition to a surface of a base paper, wherein said surface sizing composition comprises a non-film-forming polymer latex and a metallic salt, said non-film-forming polymer latex has a minimum film-forming temperature (MFFT) of greater than 70° C., and the amount of said surface sizing composition applied to the base paper, as measured in dry weight of solid content, is 6-20 kg/Ton of base paper, wherein 40%-60% by weight is metallic salt; and drying said surface-sized base paper, whereby said surface sizing composition does not form a continuous film on the sized surface.

14. The method of claim 13, wherein said base paper is internally sized to have Hercules Sizing Test (HST) value in the range of 10-1000 seconds prior to surface sizing.

15. A paper that is sized according to a surface sizing method, the method comprising:

applying a surface sizing composition to a surface of a base paper, wherein said surface sizing composition comprises a non-film-forming polymer latex and a metallic salt, said non-film-forming polymer latex has a minimum film-forming temperature (MFFT) of greater than 70° C., and the amount of said surface sizing composition applied to the base paper, as measured in dry weight of solid content, is 6-20 kg/Ton of base paper, wherein 40%-60% by weight is metallic salt; and drying said surface-sized base paper, whereby said surface sizing composition does not form a continuous film on the sized surface.

* * * * *